US008498550B2

(12) United States Patent
Akagawa

(10) Patent No.: US 8,498,550 B2
(45) Date of Patent: Jul. 30, 2013

(54) IMAGE FORMING APPARATUS WITH ION GENERATING FUNCTION

(75) Inventor: Yuhi Akagawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 301 days.

(21) Appl. No.: 12/943,365

(22) Filed: Nov. 10, 2010

(65) Prior Publication Data

US 2011/0116827 A1 May 19, 2011

(30) Foreign Application Priority Data

Nov. 18, 2009 (JP) ..... 2009-263039

(51) Int. Cl.
*G03G 21/20* (2006.01)

(52) U.S. Cl.
USPC ..... 399/93; 399/92

(58) Field of Classification Search
USPC ..... 399/92, 93, 98
See application file for complete search history.

(56) References Cited

U.S. PATENT DOCUMENTS

| | | | | |
|---|---|---|---|---|
| 6,501,922 | B2 * | 12/2002 | Ihara et al. | 399/92 |
| 7,616,912 | B2 * | 11/2009 | Nishimura et al. | 399/92 |
| 2008/0038008 | A1 * | 2/2008 | Fujita et al. | 399/92 |
| 2008/0217556 | A1 * | 9/2008 | Kagawa et al. | 250/423 R |
| 2008/0219695 | A1 | 9/2008 | Doshohda et al. | |

FOREIGN PATENT DOCUMENTS

| | | |
|---|---|---|
| JP | 2005-4144 | 1/2005 |
| JP | 2005-55515 | 3/2005 |
| JP | 2006-208718 | 8/2006 |
| JP | 2008-250289 | 10/2008 |

* cited by examiner

*Primary Examiner* — Sandra Brase
(74) *Attorney, Agent, or Firm* — Nixon & Vanderhye P.C.

(57) ABSTRACT

A copier comprises a housing, an image reading section, an image forming section, a paper discharge section, a paper supply section and an ion generating unit. The ion generating unit is disposed below the paper discharge section and above the paper supply section. The ion generating unit includes a duct that defines a path of flow guiding air sucked from outside of the housing to outside of the housing again.

5 Claims, 9 Drawing Sheets

IMAGE FORMING APPARATUS WITH ION GENERATING FUNCTION

CROSS REFERENCE

This Nonprovisional application claims priority under 35 U.S.C. §119(a) on Patent Application No. 2009-263039 filed in Japan on Nov. 18, 2009, the entire contents of which are hereby incorporated by reference.

BACKGROUND OF THE INVENTION

The present invention relates to an image forming apparatus equipped with an ion generating unit that has an ion generating function.

It is no exaggeration to say that an image forming apparatus such as a copier or a printer is an essential device in office; in fact, they are installed in most offices. Besides, in recent years, image forming apparatus are also spreading in ordinary households and hospitals, and have become an article very close to us.

By the way, among the image forming apparatus are known such ones that suck air from surroundings of the image forming apparatus into the interior of its housing, supply the air to its image forming section and fuser section, and then exhaust the air outside the image forming apparatus. Among such image forming apparatus, there is an image forming apparatus comprising an air cleaning section configured so as to prevent hazardous substances generated inside the apparatus from being emitted outside the apparatus, by removing hazardous substances contained in an air current to be released outside the apparatus, thus cleaning the air current, and then by supplying negative ions (for example, refer to Japanese Patent Unexamined Publication No. 2005-4144 bulletin).

In the technique as described in the above mentioned Japanese Patent Unexamined Publication No. 2005-4144 bulletin, in order to meet the need for removing toner powder, dust, ozone and the like that are occurring with the image forming operation of the image forming-section, it is unavoidable to dispose an ion generating section with an electrode in the proximity of the image forming section and in the air current that is formed around the image forming section. As a result, a problem that the efficiency of generating ions of the ion generating section deteriorates at an early stage has occasionally occurred due to an influence of such as silicon and/or the like generated around the image forming section. Accordingly, there has been a problem that the capability to clean the air around the image forming apparatus deteriorates as a period service of the image forming apparatus gets longer.

On the other hand, in a case where a unit provided with an air cleaning function is disposed at the outside of the image forming apparatus so as to take a large distance between the ion generating section and the image forming section, extra space becomes necessary for installing such a unit; consequently, there arises a problem that the space required for installing such an image forming apparatus increases.

The present invention is directed to providing an image forming apparatus capable of maintaining a function of stable generation of ions for an extended period of time, without increasing the space required for installing the image forming apparatus.

SUMMARY OF THE INVENTION

An image forming apparatus according to the present invention is provided with an ion generating function, and comprises a housing, an image forming section, a paper discharge section, a paper supply section and an ion generating unit. The image forming section is configured so as to carry out an image forming process based on image data supplied. The paper discharge section is disposed so as to fit into the interior of the housing in plane view, and is configured so as to retrievably contain paper that has undergone an image forming process in the image forming section. The paper supply section is disposed below the paper discharge section, and is configured so as to contain paper to be supplied to the image forming section.

The ion generating unit is disposed below the paper discharge section and above the paper supply section. The ion generating unit includes a duct defining a path of flow guiding the air that is sucked in from outside of the housing to outside of the housing again, and an ion generating device disposed in the duct.

In this configuration, the ion generating device of the ion generating unit housed inside the image forming apparatus is disposed in the duct of which respective ends communicate with outside of the housing.

This results in positioning the ion generating device in a space isolated from the space where the image forming section resides in the housing, and thus influence of silicon or the like, which is generated from the image forming section, on the ion generating device is prevented.

Also, because the ion generating unit is disposed utilizing effectively a vacant space left between the paper discharge section and the paper supply section inside the housing, it does not have to occur that the ion generating unit protrudes outside the housing; consequently, even with an ion generating unit installed, the space required for installing the image forming apparatus does not increase.

Further, because the paper supply section is disposed between the installation plane of the image forming apparatus and the ion generating unit, it is enabled to dispose the ion generating unit at a height apart from the ground; thus, it is less likely that penetration of dust or the like into the ion generating unit occurs.

In the above mentioned, configuration, it is preferred that a filter for cleaning the air sucked into the duct is further provided at a first end located on a side where air is sucked into the duct. Provided with such a filter, the ion generating device becomes less likely to come into contact with dust; thus, further extension of service life of the ion generating unit becomes to he sought.

According to the present invention, it is enabled to maintain a function of stable generation of ions for an extended period of time, without increasing the space required for installing an image forming apparatus.

DETAILED DESCRIPTION OF THE INVENTION

Figure 1:
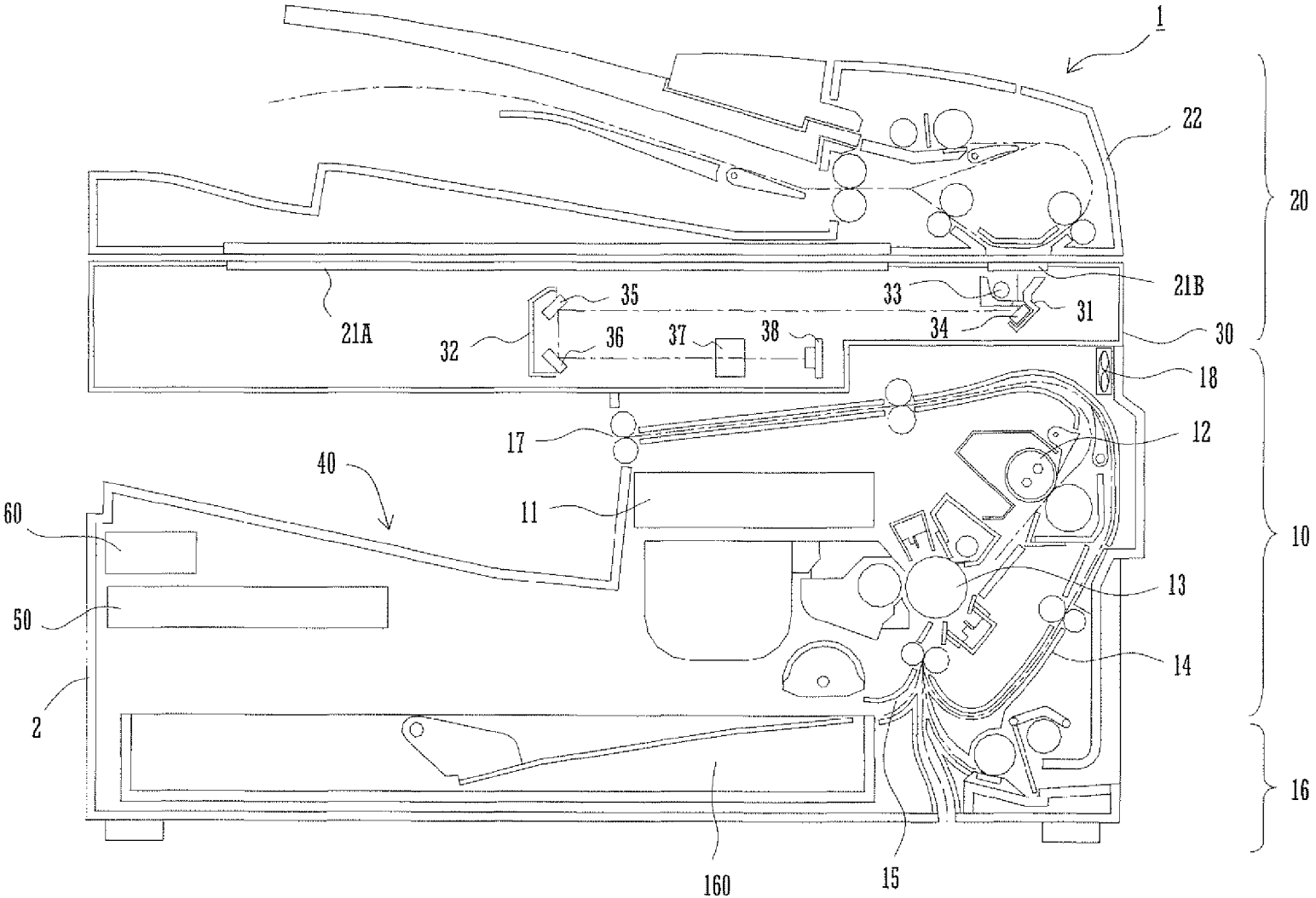
FIG. 1 is a drawing showing an outline of a copier according town embodiment of the present invention.

FIG. 1 is a drawing showing a configuration of a copier 1 according to an embodiment of the present invention. As shown in the figure above, the copier 1 comprises a document reading section 20, an image forming section 10 and a paper supply section 16.

The document reading section 20 comprises document tables 21A, 21B made of a transparent glass each, a scanner unit 30 for reading an image of a document that is placed on the document table 21A or 21B, and an automated document feeder (henceforth referred to as RADF) 22, which is capable of processing a double sided document, for automatically supplying and conveying the document to the document table 21B.

The document table 21A is used when a document is read in a document stationary mode, whereas the document table 21B is used when a document is read in a document feeding mode using the RADF 22. The RADF 22 includes a document tray, and conveys a plurality of documents that are placed on the document tray automatically piece by piece onto the document table 21B. Besides, the RADF 22, so as to have the scanner unit 30 read a single side or both sides of a document depending on a user's choice, comprises a conveying path for a single sided document, a conveying path for a double sided document, a conveying path switching means, a group of sensors or the like to monitor and supervise the state of the document passing each section.

The scanner unit 30 comprises a first scan unit 31, a second scan unit 32, an optical lens 37 and a photoelectric conversion element (henceforth referred to as CCD) 38. The first scan unit 31 is equipped with a lamp reflector assembly 33 to give an exposure of a document face and a first reflecting mirror 34 for leading a reflected light image from the document to the CCD 38. The second scan unit 32 is equipped with a second reflecting mirror 35 and a third reflecting mirror 36 for leading a reflected light image from the first scan unit 31 to the CCD 38. The optical lens 37 forms an image of the reflected light image from the document on the CCD 38. The CCD 38 converts the reflected light image from the document into an electrical image signal.

With the above mentioned configuration of the document reading section 20, an image of the document placed on the document table 21 is formed on the CCD 38 line by line sequentially, and thus the image of the document is read. The image data that have been read by the scanner unit 30, after having been sent to an image processing section which is not illustrated, having undergone a variety of image processing, and once being stored in a memory section provided in the copier 1, are then transferred to the image forming section 10 in response is to output instructions.

To the image forming section 10 is formed a paper conveying path between areas from the paper supply section 16 where paper to undergo an image forming process is contained, via an image forming position, to a paper discharge roller 17 that discharges paper to a paper discharge section 40 of an intra-body paper discharge model. The paper discharge section 40 is disposed so as to fit into the interior of a housing of the copier in plane view, and is configured so as to contain paper, which has undergone the image forming process in the image forming section 10, retrievably from the front of the housing.

Moreover, the image forming section 10 is equipped with a conveyor system along the paper conveying path, a laser writing unit 11, and an electrophotography processing section 13 for forming an image.

The laser writing unit 11 comprises: a semiconductor laser source that emits a laser beam depending on the image data supplied from the above mentioned document reading section 20 or image data transferred from an external instrument such as personal computer; a polygonal mirror that deflects a laser beam at an equal angular velocity; and a f-θ (theta) lens for making a correction such that the laser beam deflected at the equal angular velocity scans at a uniform rate on the photoconductor drum in the electrophotography processing section is 13, and so forth.

The electrophotography processing section 13 comprises, around the photoconductor drum as an image bearing member, an electrifier for charging the photoconductor drum with electricity uniformly, a developing device for supplying a developer an electrostatic latent image formed on the photoconductor drum by the laser writing unit 11, a transcription device for transcribing onto paper a developer image on the photoconductor drum, a stripper for stripping paper off the photoconductor drum, a cleaning device for removing the developer remaining on the photoconductor drum, and a static eliminator for discharging static electricity from a surface of the photoconductor drum.

Additionally, on the upstream side of the electrophotography processing section 13 in the paper conveying path is disposed a conveying section 15 that conveys paper contained in a paper cassette 160 of the paper supply section 16 to a transcription site located between the photoconductor drum and the transcription device in the electrophotography processing section 13. Also, on the downstream side of the electrophotography processing section 13 in the paper conveying path is disposed a fuser 12 for fixing by heat and pressure a non-fused developer image adhering onto paper. Further, on the downstream side of the fuser 12 is disposed a resupplying path for supplying paper again to form an image again to a rear face of the paper that has undergone a fixing. And, in the proximity of the fuser 12 is disposed an exhaust fan 18 configured so as to discharge gas surrounding the electrophotography processing section 13 and the fuser 12 to outside of the copier 1.

The copier 1 comprises a power supply unit 50 and an ion generating unit 60 above the paper supply section 16 and below the paper discharge section 40. The power supply unit 50 is configured so as to supply electric power to each part of the copier 1.

The ion generating unit 60 is configured so as to ionize water vapor in the air by corona discharge and to generate approximately equal amounts of positive ions and negative ions. In this embodiment, the positive ion is a hydrogen ion ($H^+$) with a plurality of water molecules surrounding thereof, and is represented as $H^+(H_2O)_m$ (m denotes a natural number). On the other hand, the negative ion is an oxygen ion ($O_2^-$) with a plurality of water molecules surrounding thereof, and is represented as $O_2^-(H_2O)_n$ (n denotes a natural number). The positive ions and/or negative ions, when they adhere to the surface of a bacterium floating around the copier 1, chemically react and generate hydrogen peroxide $H_2O_2$ as an activated species or hydroxyl group free radicals·OH. The hydrogen peroxide $H_2O_2$ or the hydroxyl group free radicals·OH, by exhibiting an extremely strong activity, can sterilize bacteria floating in the air.

Figure 2A:
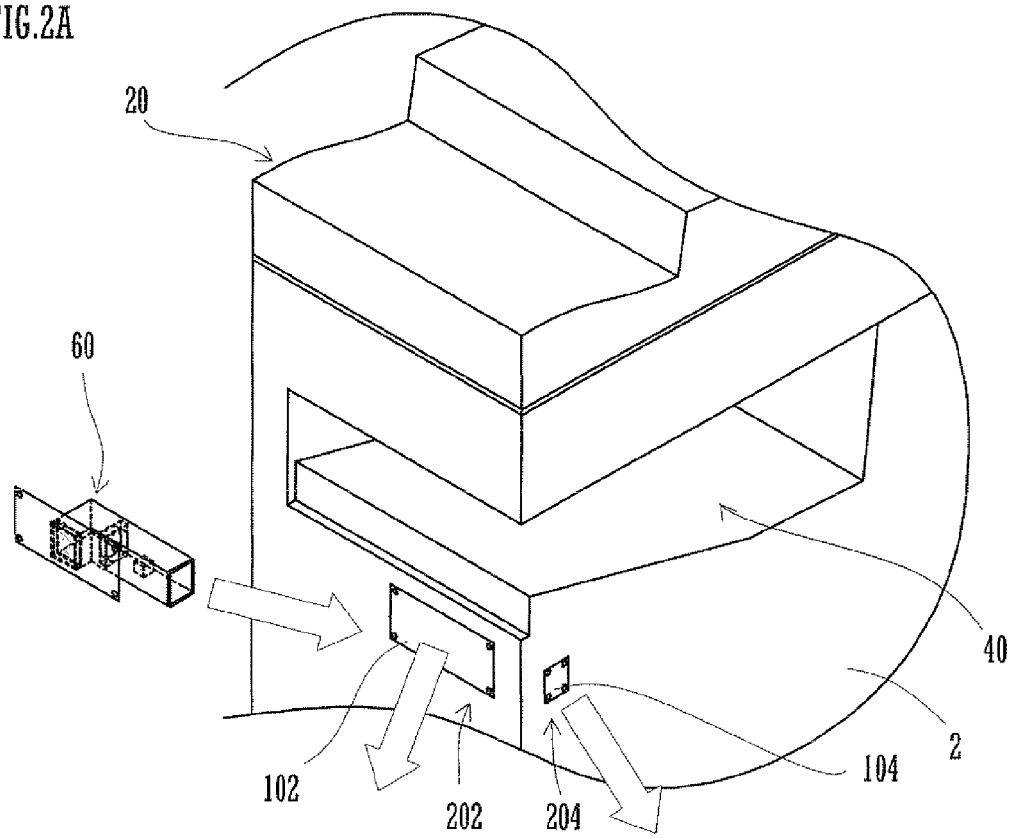
FIG. 2A is a drawing showing a state before an ion generating unit is installed in the copier.

As shown in FIG. 2A, the housing 2 comprises a first opening 202 and a second opening 204 to install the ion generating unit 60. The first opening 202 and the second opening 204 are covered with a cover member 102 and a cover member 104 respectively. Because the cover member 102 and the cover member 104 are screwed to the housing 2, they are detachable from the housing arbitrarily.

Figure 2B:
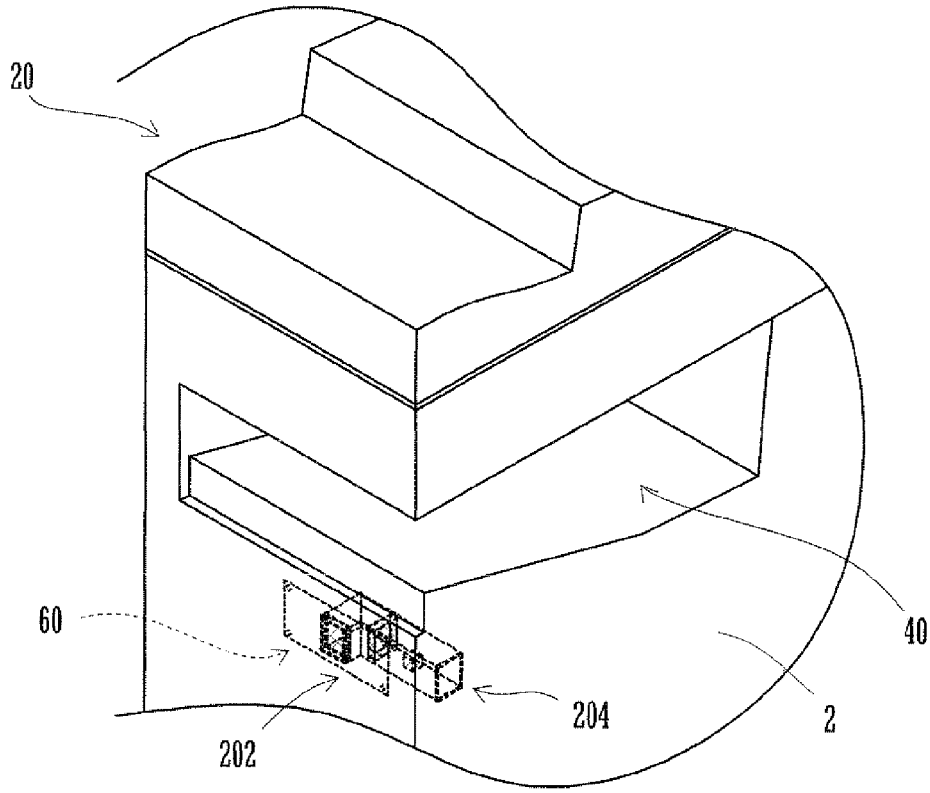
FIG. 2B, is a drawing showing a state after the ion generating unit is installed in the copier.

When the ion generating unit 60 is installed inside the copier 1, as shown in FIG. 2A, the cover member 102 and the cover member 104 that are respectively screwed to the side face and the front face of the housing 2 of the copier 1 are first removed. Then, as shown in FIG. 2B, through the first opening 202 the ion generating unit 60 is inserted into the interior of the housing 2 of the copier 1.

Figure 3:
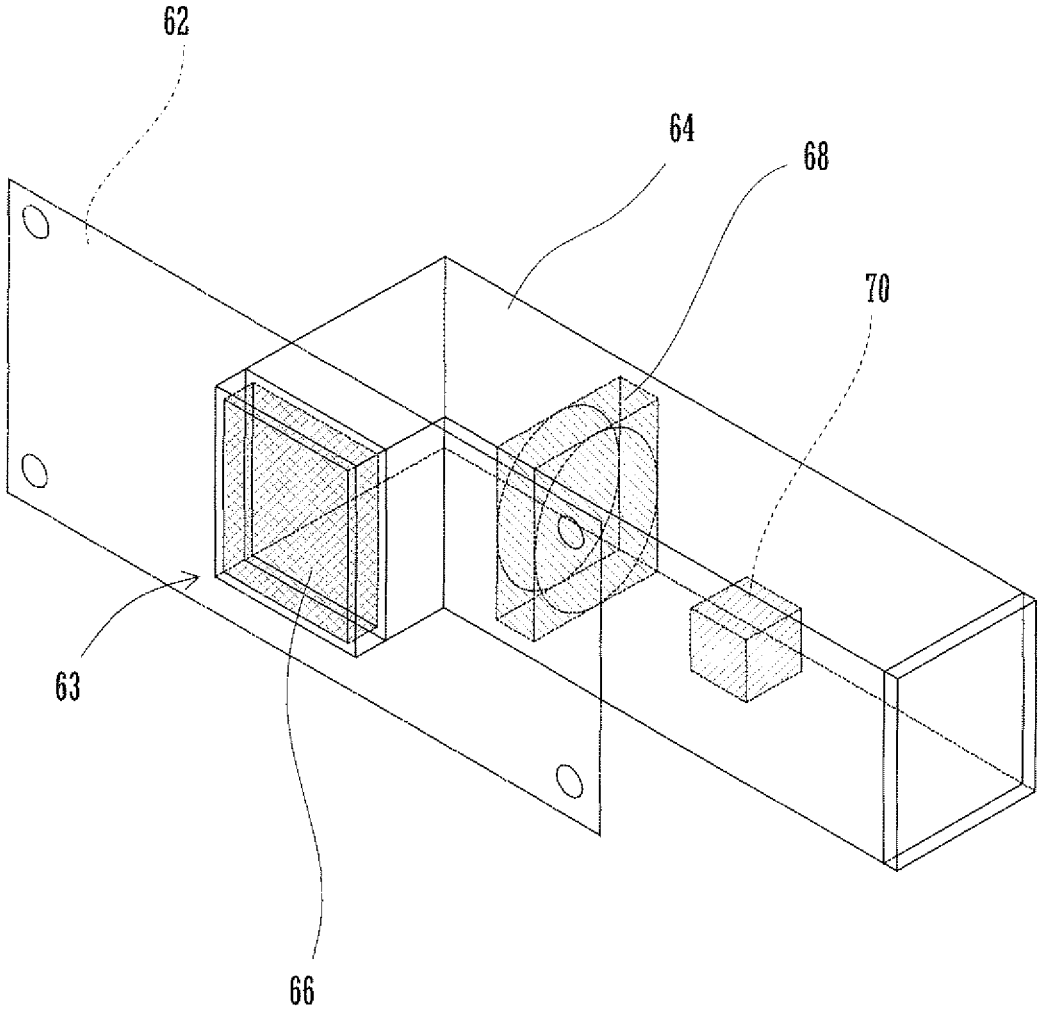
FIG. 3 is a drawing showing an outline of a configuration of the ion generating unit.

As shown in FIG. 3, the ion generating unit 60 comprises a mounting plate 62, a duct 64, a filter 66, a fan 68 and an ion generating device 70. The mounting plate 62 is configured so as to be of the same size same as the cover member 102, and so as to be attachable to the housing 2 of the copier 1 with screws in to such a manner as to cover the first opening 202.

The duct 64 is configured so as to define a pathway of air flow, and is connected to the mounting plate 62. To be concrete, an opening aperture 63 corresponding to a cross section of the duct 64 is formed to the mounting plate 62, and the duct 64 is is fitted into the opening aperture 63. Although the duct 64 is glued to the mounting plate 62 by an adhesive in this embodiment, t is also possible that the duct 64 is screwed to the mounting plate 62 or likewise so as to be separable each other.

The filter 66 is installed in the proximity of a first end that is to be an air suction side of the duct 64. The filter 66 is configured so as to capture dirt such as dust, toner, paper powder and the like that are entering into the duct 64. For the filter 66, although employing the one that has a common function of capturing dust is fine as a general rule, adopting the one that has a function of adsorbing silicon is preferred.

The fan 68 is installed between the filter 66 and the ion generating device 70 in the duct 64. The fan 68 is configured so as to generate an air flow in the duct 64 from the first end toward a second end that is to be an air exhaust side.

The ion generating device 70 is configured so as to ionize water vapor in the air inside the duct 64 by corona discharge, and so as to generate approximately equal amounts of positive ions and negative ions. However, configuration of the ion generating device 70 is not limited to that of this embodiment.

Figure 4:
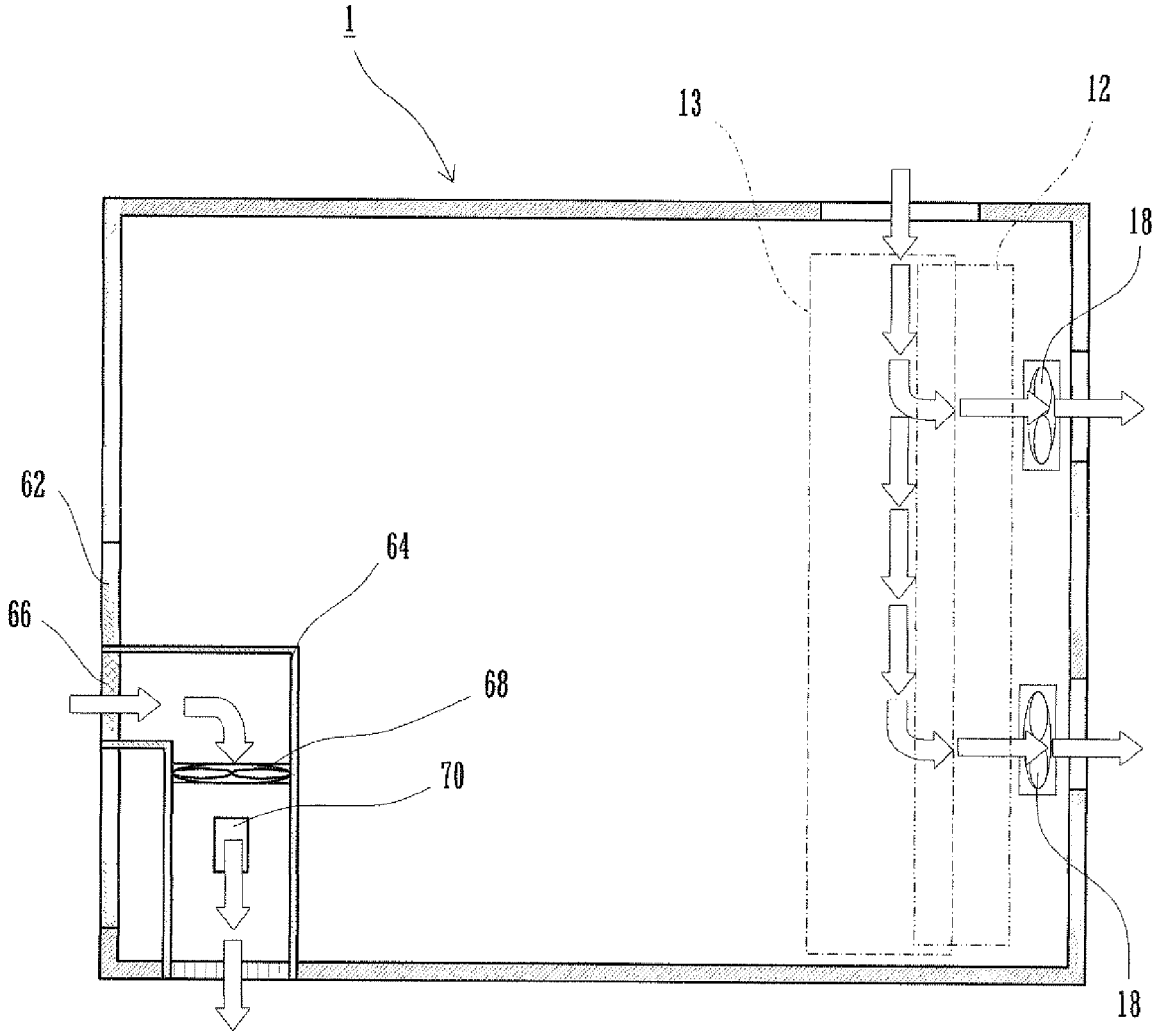
FIG. 4 is a drawing showing a manner in which the ion generating unit is installed in the copier.

In the above-mentioned configuration, the ion generating device 70 is disposed inside the duct 64; and this results in the ion generating device 70 installed in a space that is completely isolated from the air inside the copier 1, as shown in FIG. 4. In particular, because the ion generating device 70 is disposed in such a manner that mixture will not occur with an air current that is produced in the vicinity of the electrophotography processing section 13 and the fuser 12 suction of an exhaust fan 18, deterioration of efficiency of generating ions of the ion generating device 70 due to damage and/or pollution of corona electrodes or the like will not occur; thus, efficiency of generating ions of the ion generating device 70 is maintained for an extended period of time.

Besides, because an air intake port of the ion generating unit 60 is installed in a face different from the face in which the exhaust fan 18 is installed in the housing of the copier 1, it is prevented from occurring that the air exhausted from the exhaust fan 18 is sucked into the ion generating unit 60.

As a general rule, is preferred that the ion generating unit 60 is disposed at a position far apart from the electrophotography processing section 13 (in particular, the developing device) and the fuser 12. For example, in a case where the electrophotography processing section 13 and the fuser are located on the right side of the copier 1, it is preferred that the ion generating unit is disposed on the left side of the copier 1.

Further, because the filter 66 for cleaning the air is installed on the air suction side in the duct 64, damage and/or pollution of corona electrodes of the ion generating device 70 is prevented more effectively. Accordingly, it is enabled that efficiency of generating ions of the ion generating device 70 is maintained high over an entire usable period of the copier 1.

Figure 5A:
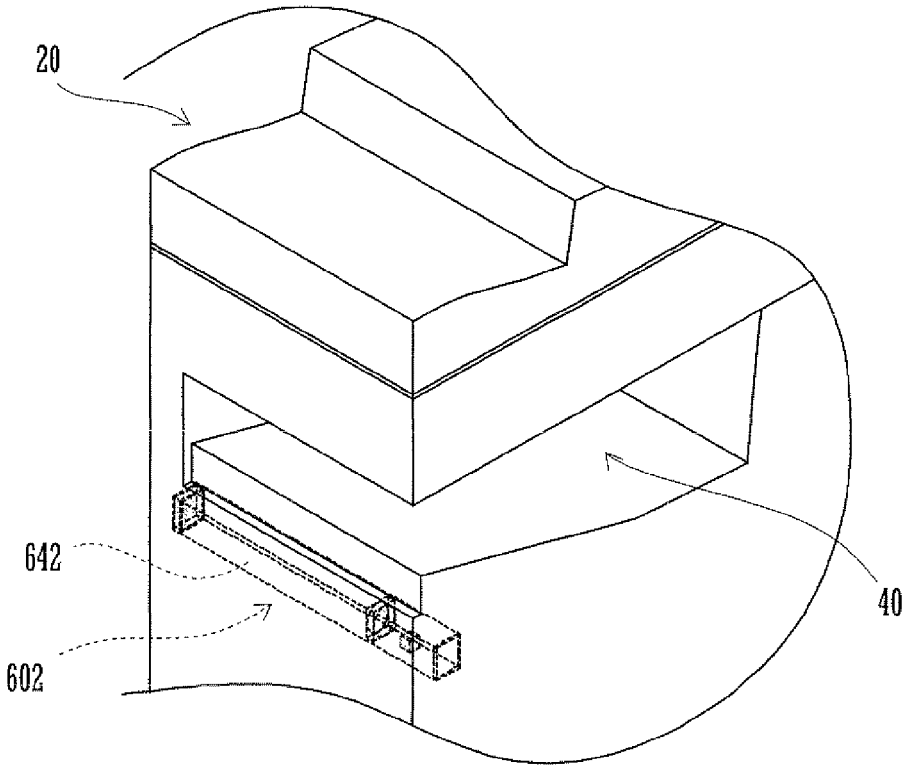
FIG. 5A is a drawing showing a variation of an ion generating unit employing a linear duct extending through the entire length in the direction of the depth of the copier.

Subsequently, using F G. 5A and FIG. 5B, variations of an ion generating unit are explained. Although the above mentioned ion generating unit 60 uses a L-shaped duct 64 in plane view, it is also possible, as shown in FIG. 5A, to use a linear duct 642 extending through the entire length in the direction of the depth of the copier 1. In installing an ion generating device 602 having such a duct 642, it is recommended, for example, that an air suction port be disposed in the rear face of the housing of the copier 1 and that an air exhaust port be disposed in the front face of the housing. Because there is relatively much room available over the entire length of the direction of the depth of the copier 1 in between the paper supply section 16 and the paper discharge section 40, installing the ion generating device 602 can be fairly easy.

Figure 5B:
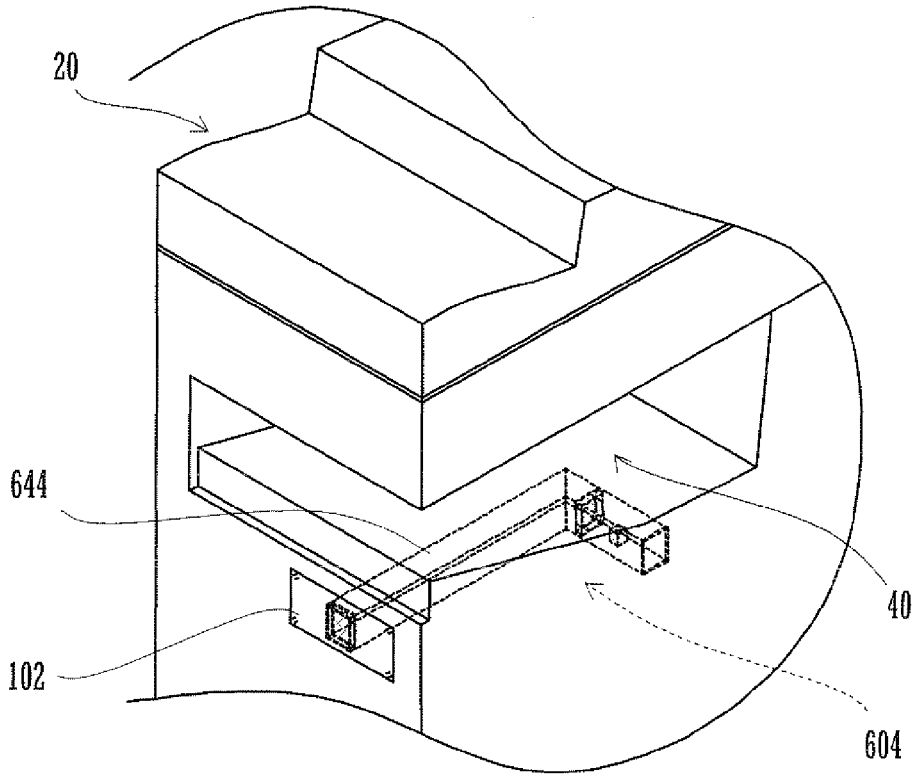
FIG. 5B is a drawing showing another variation of an ion generating unit employing a duct extending long in the direction of the width of the copier.

Additionally, although, in the above mentioned ion generating unit 60, both the air suction port and the air exhaust port are disposed in the proximity of the side face of the housing of the copier 1, it is also possible, as shown in FIG. 5B, to cause to exhaust the air from a position apart from a side face of the housing (for instance, middle of the direction of the width of the copier 1). In this case, it is recommended to use, instead of the ion generating unit 60, an ion generating unit 604 having a duct 644 extending long in the direction of the width of the copier 1.

Figure 6A:
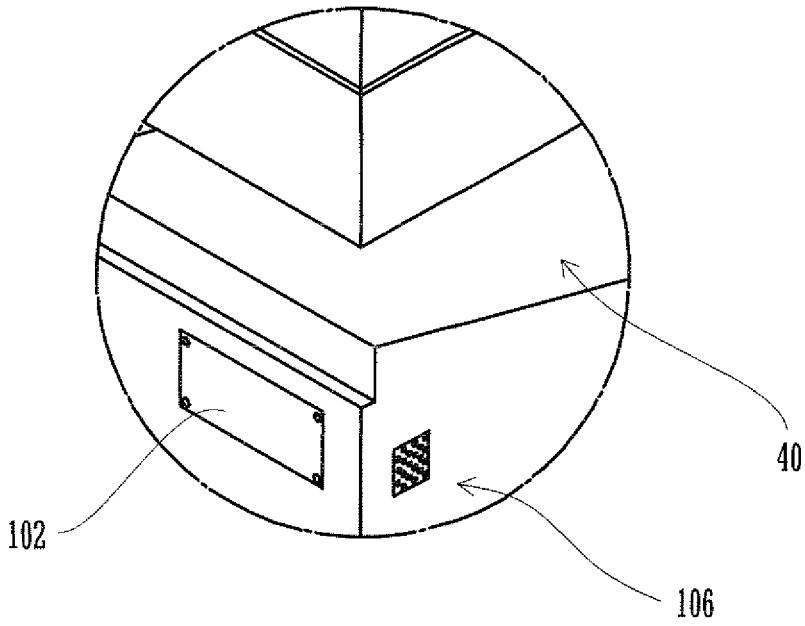
FIG. 6A is a drawing showing a configurative variation of the housing of the copier in which the housing of the copier is provided with a mesh-shaped air vent in advance.
Figure 6B:
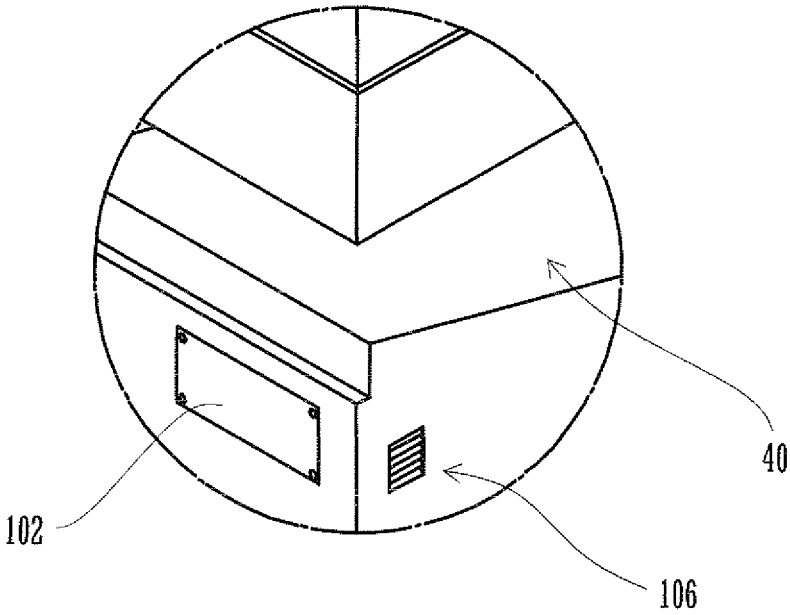
FIG. 6B is a drawing showing another configurative variation of the housing of the copier in which the housing is to provided with a louver in advance.

Subsequently, using FIG. 6A and FIG. 6B, configurative variations of an air exhaust port is explained. In securing an air exhaust port of the ion generating units 60, 602, and 604, the cover member 104 was to be removed from the housing; however, as shown in FIG. 6A, the housing of the copier 1 may be provided with a mesh-shaped air vent in advance. Further, as shown in FIG. 6B, the housing of the copier 1 may be provided with a louver in advance. With the configuration as described in FIG. 6A or FIG. 6B, it is not necessary to remove the cover member 104 from the housing when the ion generating unit 60, 602 or 604 is installed. Besides, even when the ion generating unit 60, 602 or 604 is not installed, visual appearance of the copier 1 is not spoiled.

Figure 7:
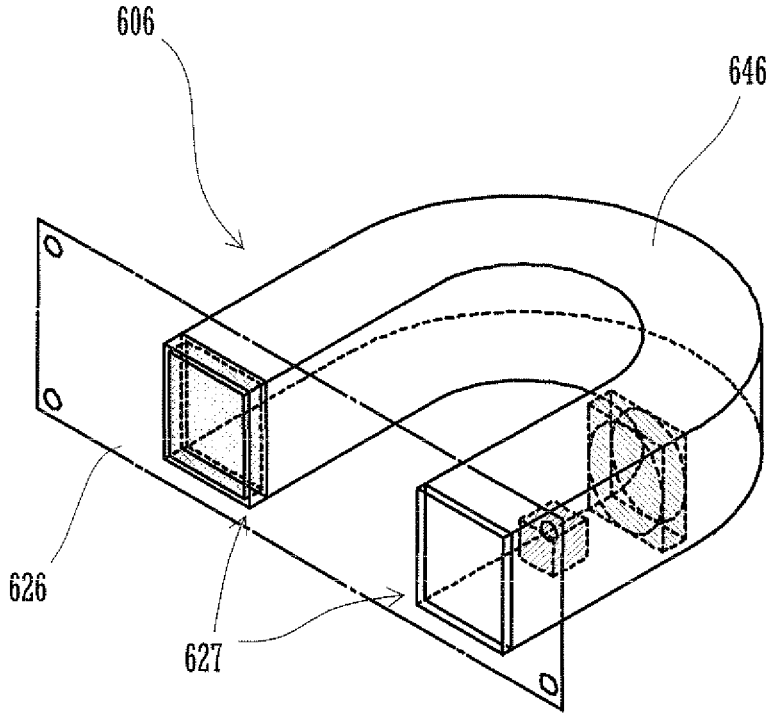
FIG. 7 is a drawing showing a variation of an ion generating unit.

Moreover, although, in the above mentioned embodiments, intake and exhaust of the air to and from the ion generating unit are performed respectively in separate faces of the housing, it is also possible to perform intake and exhaust of the air to and from the ion generating unit in an identical face of the housing. For example, as shown in FIG. 7, an ion generating unit 606 having a U-shaped duct 646 in plane view may be used. In this case, it is preferred that the ion generating unit 606 is provided with a mounting plate 626 on which two opening apertures 627 are formed of a size corresponding to a cross section of the duct 646. With such a configuration, installing the ion generating unit 606 to the copier 1 becomes easier.

Figure 8:
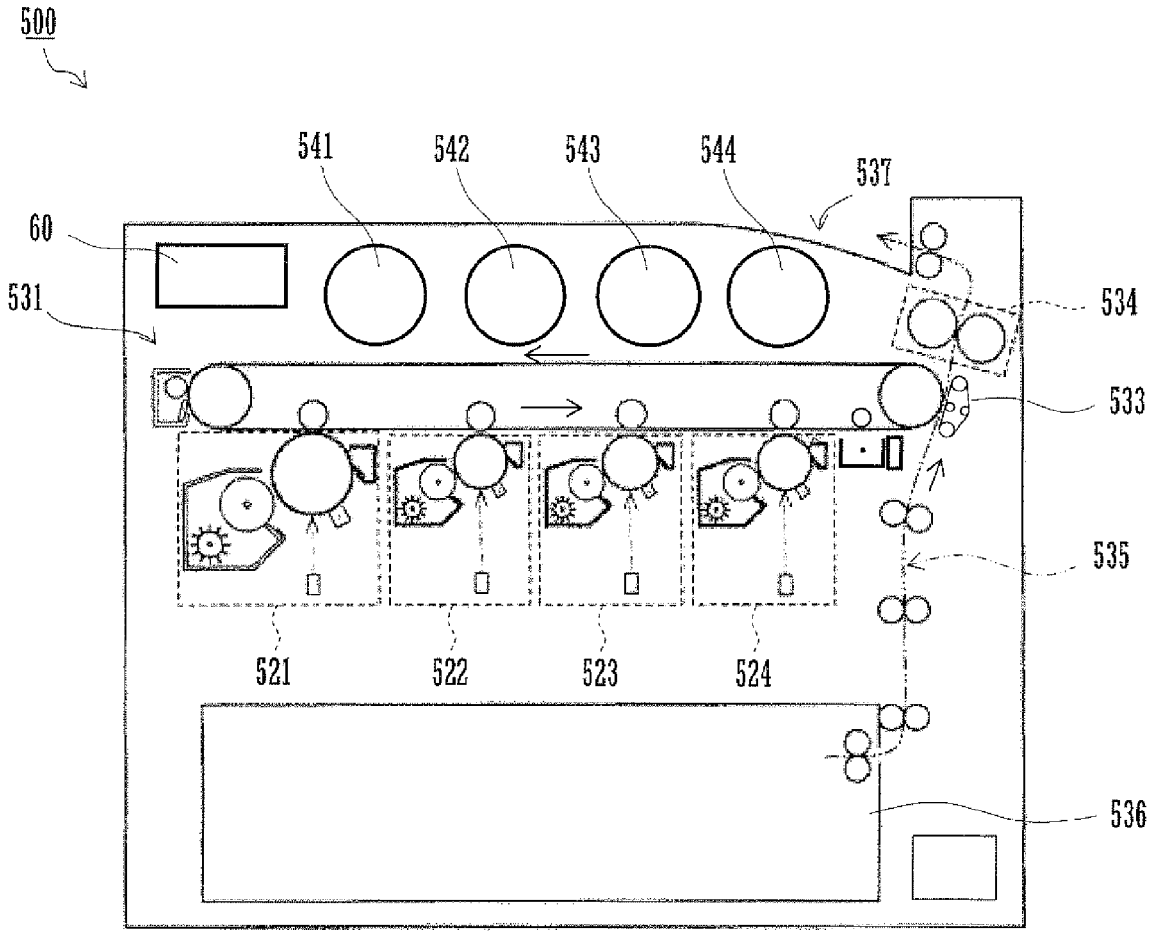
FIG. 8 is a drawing showing an outline of an image forming apparatus according to an embodiment of the present invention.

Subsequently, using FIG. 8, a configuration of an image forming apparatus 500 according to another embodiment of the present invention is briefly explained. The image forming apparatus 500 comprises a paper supply section. 536, a paper discharge section 537 of a top face paper discharge model, and a paper conveying path 535 for guiding paper in the paper supply section 536 to the paper discharge section 537. The paper discharge section 537 is disposed so as to fit into the interior of a housing of the image forming apparatus 500 in plane view, and is configured so as to contain paper, which has undergone the image forming process, retrievably from the front of the housing.

Further still, the image forming apparatus 500 comprises four image forming stations 521-524 that are configured so as to perform respectively image forming processes of an electrophotography formula using image data corresponding to each hue of black, cyan, magenta and yellow. Above the imaging station 521-524 is installed an intermediate transcription belt unit 531. Above the intermediate transcription belt unit 531 and below the paper discharge section 537 are installed an ion generating unit 60 and a plurality of toner refilling containers 541-544.

Meanwhile, on the other side of the intermediate transcription belt unit 531 is installed a secondary transcription belt 533 sandwiching the paper conveying path 535 in between. Then, on the downstream side of the second transcription belt 533 in the paper conveying path 535 is installed. a fuser unit 534.

In this embodiment, the ion generating unit 60 is disposed utilizing a vacant space below the paper discharge section 537 and beside the toner refilling container 541-544. Additionally, since the basic structure of the ion generating unit 60 is the same as ones of the aforementioned embodiments, description thereof is omitted.

Figure 9:
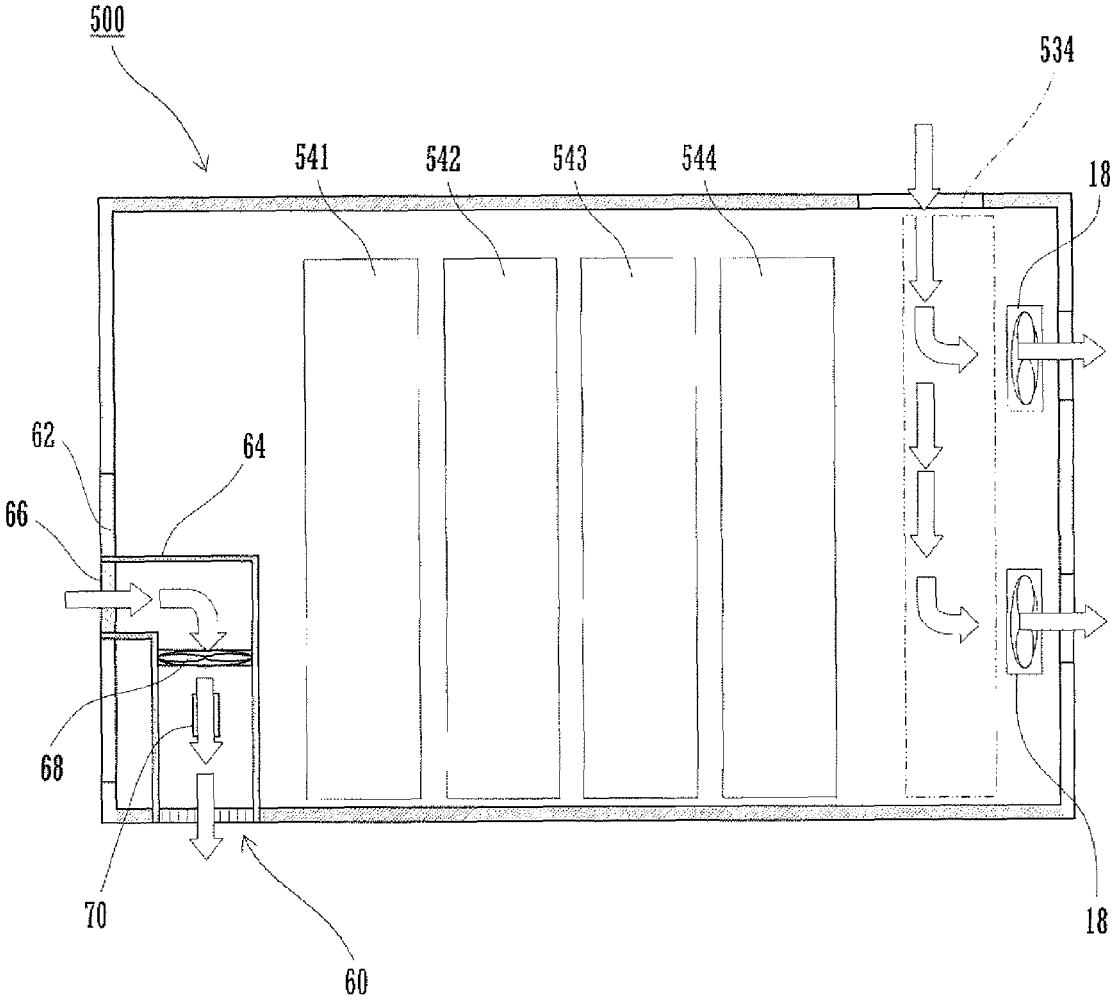
FIG. 9 is a drawing showing a manner in which an ion generating unit is installed in the image forming apparatus.

In this manner, by disposing the ion generating unit effectively in a vacant space below the paper discharge section, installation. thereof can be realized without upsizing the apparatus. Also in the image forming apparatus 500, as shown in FIG. 9, because an ion generating device 70 of the ion generating unit 60 is disposed in the interior space of the image forming apparatus 500 in an isolated manner, efficiency of generating ions of the ion generating device 70 is maintained high for an extended period of time.

Moreover, although a configuration of the image forming apparatus 500 has been explained here in which an image scanner is not provided upside thereof, the present invention can be suitably implemented even when the image scanner is provided upside the image forming apparatus 500.

Although, in the above ,mentioned embodiments, cross-sections of the ducts 64, 642, 644 and 646 are of rectangular forms, cross-section of the duct may be of a circular form, of other geometries.

The above explanation of the embodiments is nothing more than illustrative in any respect, nor should be thought of as restrictive. Scope of the present invention is indicated by claims rather than the above embodiments. Further, it is intended that all changes that are equivalent to a claim in the sense and realm of the doctrine of equivalence be included within the scope of the present invention.

What is claimed is:

1. An image forming apparatus with an ion generating function, the apparatus comprising:

a housing;

an image forming section located in a first space inside the housing and configured so as to carry out an image forming process based on image data supplied;

a paper discharge section disposed so as to fit into the interior of said housing in plane view and configured so as to retrievably contain paper that has undergone the image forming process in said image forming section;

a paper supply section disposed below said paper discharge section and configured so as to contain paper to be supplied to said image forming section; and an ion generating unit with an ion generating function disposed below said paper discharge section and above said paper supply section; wherein said ion generating unit includes:

a duct configured so as to define a path of flow for guiding air that is sucked into the duct from outside of said housing and to discharge the air back outside of said housing, the interior of the duct being isolated from the first space in the housing, and wherein the duct passes through the housing; and an ion generating device disposed in said duct.

2. The image forming apparatus as claimed in claim 1, wherein a filter for cleaning the air that is sucked into said duct is provided at a first end located on a side where air is sucked into said duct.

3. The image forming apparatus as claimed in claim 2, wherein said first end of said duct is disposed in a face of the housing that is different from a face where an exhaust section for said image forming section is located in said housing.

4. The image forming apparatus as claimed in claim 1, wherein said image forming section is disposed at a first side edge section in said housing, and said ion generating unit is disposed at a second side edge section located opposite said first side edge section.

5. The image forming apparatus as claimed in claim 1, wherein a first opening is provided in a side face of said housing, a second opening is provided in a front face of said housing, and said duct is configured so as to communicate with said first opening and said second opening respectively.

* * * * *